US009662664B2

(12) United States Patent
Ballhause

(10) Patent No.: US 9,662,664 B2
(45) Date of Patent: May 30, 2017

(54) CENTRIFUGE WITH AUTOMATICALLY OPENING ROTOR COVER

(71) Applicant: Thermo Electron LED GmbH, Langenselbold (DE)

(72) Inventor: Norman Ballhause, Windhausen (DE)

(73) Assignee: Thermo Electron LED GmbH, Langenselbold (DE)

( * ) Notice: Subject to any disclaimer, the term of this patent is extended or adjusted under 35 U.S.C. 154(b) by 0 days.

(21) Appl. No.: 14/731,546

(22) Filed: Jun. 5, 2015

(65) Prior Publication Data

US 2015/0352566 A1 Dec. 10, 2015

(30) Foreign Application Priority Data

Jun. 6, 2014 (DE) ..... 10 2014 008 256

(51) Int. Cl.
*B04B 7/02* (2006.01)

(52) U.S. Cl.
CPC ..... *B04B 7/02* (2013.01); *B04B 2007/025* (2013.01)

(58) Field of Classification Search
CPC ..... B04B 7/02; B04B 2007/025
See application file for complete search history.

(56) References Cited

U.S. PATENT DOCUMENTS 2,783,938 A * 3/1957 Grela ..... B04B 5/0414 220/324
5,004,453 A * 4/1991 Hayasaka ..... B04B 7/02 494/39
5,067,938 A * 11/1991 Uchida ..... B04B 7/06 312/327
6,056,684 A * 5/2000 Linder ..... B04B 7/02 494/12
9,149,815 B2 * 10/2015 Kohn ..... B04B 5/0414
(Continued)

FOREIGN PATENT DOCUMENTS

CH 361540 A 4/1962
DE 4323844 A1 * 1/1995 ..... B04B 5/0421
(Continued)

OTHER PUBLICATIONS

United Kingdom Intellectual Property Office, Patents Act 1977: Search Report under Section 17, Application No. GB1509035.0, dated Aug. 25, 2015 (4 pages).
(Continued)

*Primary Examiner* — Charles Cooley
(74) *Attorney, Agent, or Firm* — Wood Herron & Evans LLP

(57) ABSTRACT

The present invention relates to a centrifuge, in particular, a laboratory centrifuge, with a housing comprising a centrifuge lid, which delimits the centrifuge to the outside, a rotor and a rotor cover for closing the rotor, a connecting device comprising a holding arm and a holder being provided, via which the rotor cover and the centrifuge lid can be detachably connected with each other in such a way that the rotor cover is lifted off of the rotor upon opening of the centrifuge lid and is placed on the rotor upon closing the centrifuge lid. The holding arm is detachably and movably mounted in the holder during opening and closing of the centrifuge lid, and the holding arm and the holder are spaced via a gap space when the centrifuge lid is closed.

8 Claims, 5 Drawing Sheets

(56) References Cited

U.S. PATENT DOCUMENTS

| | | | | |
|---|---|---|---|---|
| 2006/0058168 | A1* | 3/2006 | Kusumoto | B04B 7/02 494/16 |
| 2011/0051133 | A1* | 3/2011 | Ogawa | B04B 5/0407 356/246 |
| 2011/0212819 | A1* | 9/2011 | Kohn | B04B 5/0414 494/10 |
| 2013/0203581 | A1* | 8/2013 | Le Guyader | B04B 7/02 494/10 |
| 2014/0135197 | A1* | 5/2014 | Nichols | B04B 5/0414 494/14 |
| 2014/0329659 | A1* | 11/2014 | Le Guyader | B04B 7/02 494/82 |
| 2015/0352566 | A1* | 12/2015 | Ballhause | B04B 7/02 494/60 |
| 2016/0274005 | A1* | 9/2016 | Toya | G01N 1/2813 |
| 2016/0282236 | A1* | 9/2016 | Toya | G01N 1/2813 |

FOREIGN PATENT DOCUMENTS

| | | | |
|---|---|---|---|
| EP | 0301183 | B1 | 2/1989 |
| FR | 1295675 | A | 6/1962 |
| GB | 1241539 | A | 8/1971 |
| JP | 641741 | U | 1/1989 |
| WO | 95/34382 | A1 | 12/1995 |

OTHER PUBLICATIONS

Espacenet, English Machine Translation of Claim 1 for CH361540A, retrieved from http://worldwide.espacenet.com, published on Apr. 15, 1962 (1 page).

Espacenet, English Machine Translation of Claim 1 for FR1295675A, retrieved from http://worldwide.espacenet.com, published on Jun. 8, 1962 (1 page).

* cited by examiner

CENTRIFUGE WITH AUTOMATICALLY OPENING ROTOR COVER

CROSS-REFERENCE TO RELATED APPLICATIONS

The present application claims priority under 35 U.S.C. §119 of German Patent Application No. 10 2014 008 256.3, filed Jun. 6, 2014, the disclosure of which is hereby incorporated herein by reference in its entirety.

FIELD OF THE INVENTION

The present invention relates to a centrifuge and, in particular, to a laboratory centrifuge having a housing comprising a centrifuge lid that delimits the centrifuge to the outside, a rotor and a rotor cover for closing the rotor.

BACKGROUND OF THE INVENTION

Such centrifuges are widely used in laboratories, particularly in life sciences and related fields. They are used for separation of substance mixtures, for example, suspensions, emulsions or gas mixtures. Besides organic and inorganic substances, for example, microorganisms or cells can be separated from suspensions. The mixtures to be separated are fixed in containers on the rotor and accelerated on a circular path. Due to differing mass inertia, constituents of the mixture having a higher density are separated from constituents having a lower density.

Prior art centrifuges usually have an external housing comprising a centrifuge lid arranged as a hinged lid that can, in most cases, be folded open upwardly. A rotor is arranged in the interior of the housing, in which rotor the mixtures to be separated may be inserted in suitable containers. The rotor can often be closed by a separate rotor cover. On the one hand, the rotor cover prevents mixture substances to be separated from leaking from the rotor and, on the other hand, ensures that the rotor has a surface as smooth as possible on the upper side. Due to the smooth surface, the air friction of the rotor is reduced considerably during operation, as a result of which the centrifuge requires less energy. Especially in case of larger centrifuges, which are used for separation of larger mixture volumes, the power consumption can be reduced by more than half by closing the rotor with a rotor cover. However, such rotor covers are disadvantageous in that they need to be placed on the rotor and removed therefrom manually by an operator. In case of large centrifuges, the cover may weigh between two and three kilograms and in many cases the mounting on and removal from the rotor require an ergonomically unfavorable body posture. Moreover, storage space must be kept available for placing the rotor cover when the rotor is open. For an operator, removing or putting on the rotor cover on the rotor is uncomfortable and time consuming.

The object of the present invention is to eliminate these disadvantages of the prior art. Specifically, it is the object of the present invention to provide a centrifuge of the type described above, which benefits from the advantages that come with the use of a rotor cover and avoids its disadvantages such as uncomfortable or time consuming operation for the user. In other words, the operation of a generic centrifuge is to be simplified and accelerated by the present invention.

SUMMARY OF THE INVENTION

The present invention thus relates to a centrifuge, in particular, a laboratory centrifuge, having a housing comprising a centrifuge lid and delimiting the centrifuge to the outside, a rotor and a rotor cover for closing the rotor. Moreover, provision is made for a connecting device comprising a holding arm and a holder, via which the rotor cover and the centrifuge lid can be releasably connected with each other in such a way that the rotor cover is lifted off the rotor upon opening of the centrifuge lid and is placed on the rotor upon closing of the centrifuge lid. The holding arm is detachably and movably mounted in the holder during opening and closing of the centrifuge lid, and the holding arm and the holder are spaced from each other by a gap space when the centrifuge lid has been closed.

On the one hand, the object is thus achieved in a generic centrifuge by providing a connecting device, via which the rotor cover and the centrifuge lid can be detachably connected with each other in such a way that the rotor cover is lifted off the rotor upon opening of the centrifuge lid and is placed on the rotor upon closing of the centrifuge lid. The connecting device thus establishes a detachable connection between the rotor cover and the centrifuge lid. This connection causes the rotor cover to follow the movement of the centrifuge lid, for example, during opening and/or closing the centrifuge lid. If the centrifuge lid is thus opened by an operator, i.e., is folded upwards, the connecting device acts in such a way that the rotor cover is opened with the centrifuge lid and thus lifted off the rotor. In the opened state of the centrifuge lid, the rotor cover is suspended from the centrifuge lid via the connecting device such that an operator has free access to the rotor and can insert or remove the containers carrying the mixtures to be separated. In a like manner, the rotor cover follows the centrifuge lid when being closed and is placed on the rotor. When the centrifuge lid is closed, the rotor cover rests on the rotor and the centrifuge is ready for operation. The opening and closing of the rotor cover takes place automatically in the sense that an operator does not need to separately remove the rotor cover manually from the rotor or place it thereon. The operator merely opens the centrifuge lid in a conventional way, the connecting device acting as carrier carrying the rotor cover along in the opening direction of the centrifuge lid. The rotor is made accessible without further action by the operator being required. Neither will the operator need to place the rotor cover on the rotor before closing the centrifuge lid. Instead, the rotor cover is automatically placed on the rotor when the operator closes the centrifuge lid.

Generally, placing the centrifuge lid on the rotor is sufficient for the rotor to be closed during centrifuging operation. As the rotor cover does not seal the rotor hermetically, air leaks from the rotor past the rotor cover when the rotor is accelerated, creating a negative pressure inside the rotor. This negative pressure pulls the rotor cover onto the rotor and fixes it so tightly that the rotor cover does normally not need to be additionally fastened to the rotor. Accordingly, there is generally no risk that the rotor cover detaches from the rotor during centrifuging operation and causes an accident. However, it is also possible within the scope of the present invention to fasten the rotor cover to the rotor, for example, by means of snap connections or in a similar way, and to provide means for releasing the connections fastening the rotor cover to the rotor upon actuation of the centrifuge lid.

According to the present invention, the connecting device comprises a holding arm and a holder, the holding arm being releasably and movably mounted in the holder during opening and closing of the centrifuge lid. The holding arm bridges the distance between the centrifuge lid and the rotor cover when the centrifuge is closed. The holding arm is suitably mounted in the holder in a form-locking manner when the detachable connection is closed. The movable mounting serves the purpose of compensating tolerances when closing the centrifuge lid and placing the rotor cover on the rotor.

In general, it is possible to either arrange the holding arm on the rotor cover and the holder on the centrifuge lid or the holding arm on the centrifuge lid and the holder on the rotor cover. It is particularly advantageous if an end of the holding arm is arranged on the rotor cover and the other end of the holding arm is arranged in the holder on the centrifuge lid. In this way, a particularly precise guiding of the rotor cover by the centrifuge lid can be achieved. Moreover, this design allows for further embodiments, which will be described below, and is thus particularly versatile.

The rotor of the centrifuge according to the present invention rotates during operation. For a connecting device arranged outside the center of the rotor, it would be necessary to provide additional means which ensure that the rotor always comes to a halt in the same position, in which the connecting device is oriented in such a way that it can releasably connect the centrifuge lid and the rotor cover. In order to keep the construction as simple as possible and to avoid such additional means as far as possible, it is thus preferred to arrange the connecting device in the center of the centrifuge lid and the rotor cover. Accordingly, the connecting device is also arranged in the center of the rotor. The terms 'center' or 'lid/cover center' in the present context refer to any point of the respective part which lies on the axis of rotation of the rotor. The center of the rotor and the center of the centrifuge lid and the rotor cover thus lie on a vertical straight line above each other. The connecting device thus also lies at least partially on the axis of rotation of the centrifuge and the rotor or at least partially surrounds it. Thus, not only is the connecting device independent of the respective rotational position of the rotor and thus of the rotor cover, but also is the exact positioning of the rotor cover on the rotor facilitated during the placing of the rotor cover through the closing movement of the centrifuge lid.

In order to enable a free rotation of the rotor with the rotor cover and the holding arm, the holding arm and the holder are spaced from each other by a gap space when the centrifuge lid is closed. Thus, when the centrifuge lid is closed, the detachable connection between the holding arm and the holder should be disconnected in such a way that there is a distance or gap space between the holding arm and the holder, which prevents the holding arm and the holder from colliding or making otherwise contact with each other during operation of the centrifuge and rotation of the rotor. The gap space must thus also be sufficiently large to enable uneven movement or vibrations of the rotor and thus the rotor cover, in particular, when traversing the resonance during the acceleration process, without causing a contact between the holding arm and the holder. In practice, this gap space is achieved by designing the holding arm and the holder in such a way that the rotor cover is already placed on the rotor before the centrifuge lid is completely closed. Due to the continued closing movement of the centrifuge lid taking place after the rotor cover has been placed on the rotor, the detachable connection between the holding arm and the holder is released and the holding arm is lifted off and disengaged from the holder. The space between the holder and the holding arm forms the gap space. When the centrifuge lid is opened after operation, the holding arm and the holder initially move along each other to a certain extent without making any contact until the two parts of the connecting device finally engage each other, thus creating the detachable connection. In case of further opening of the centrifuge lid until it is completely open, the rotor cover is carried along by the connecting device and follows the movement of the centrifuge lid. When the centrifuge lid is completely open, the rotor cover is thus suspended from the centrifuge lid via the detachable connection. When the centrifuge lid is completely closed, it is decoupled from the rotor cover via the gap space and the detachable connection is released. The gap space according to the present invention thus enables a proper operation of the centrifuge and contributes to its safety.

Altogether, the centrifuge lid can thus be moved between three positions: The first position is the open position, in which the rotor cover is detachably attached to the centrifuge lid via the connecting device and gives access to the rotor for a user. The second position is the coupling position, in which the detachable connection of the connecting device is either just being released or established, depending on the movement direction of the centrifuge lid. The third position is the closed position, in which the centrifuge lid closes the housing and the rotor cover closes the rotor. All three positions are passed successively during opening and closing of the centrifuge lid, although the user will normally not be aware of the coupling position.

According to one embodiment of the present invention, the holding arm has a widened head, said head having a joint surface which is designed so as to be form-locking with a joint surface of the holder, preferably in such a manner that the holding arm and the holder together form a pendulum joint. The holding arm with its widened head thus engages the holder. The holder is designed as a carrier, which abuts the head of the holding arm upon opening of the centrifuge lid and carries along the holding arm and thus the rotor cover during the further opening movement of the centrifuge lid. The abutting joint surfaces of the head of the holding arm and the holder face each other. Once the joint surfaces rest against each other, they form the releasable and movable connection between the holding arm and the holder. The arrangement of a pendulum joint between the holding arm and the holder enables using the weight of the rotor cover for centering the rotor cover on the rotor. This way, a more precise positioning of the rotor cover on the rotor becomes possible than in case of a rigid connection. The length of the holding arm decisively influences the size of the possible swinging path of the rotor cover. The longer the holding arm, the larger are the possible swinging movements of the rotor cover. Generally, it is preferred to use a holding arm as short as possible in order to prevent excessive swinging of the rotor cover. At the same time, a minimum length of the holding arm is necessary for the rotor cover to exactly position itself on the rotor through its own weight. For error free opening and closing of the centrifuge lid together with the rotor cover, it is thus advantageous if the rotor cover can swing relative to the centrifuge lid but this swinging movement is kept as small as possible.

In one embodiment, the head of the holding arm is shaped as a cone or truncated cone. The lateral surface of the cone forms the joint surface of the holding arm. This can form a two-point or three-point support on the joint surface of the holder, depending on the tilt of the holding arm relative to the holder. This support provides the mobility which is necessary for establishing a pendulum joint. According to an embodiment of the present invention, however, the joint surface of the holder is a joint socket and the joint surface of the holding arm is a joint head of a ball joint. On its side facing the holder, the head of the holding arm is for this purpose shaped as a spherical cap, which constitutes the joint surface of the head. In a complementary manner, the joint surface of the holder is designed as a spherical recess. By arranging the pendulum joint between the centrifuge lid and the rotor cover as a ball joint, the swinging of the rotor cover can be kept in particularly precisely predetermined pathways. The ball joint thus enables a particularly precise positioning of the rotor cover on the rotor. This ensures an error free operation of the centrifuge and enhances its safety.

It is sometimes necessary to completely clean a centrifuge between the work cycles. This particularly applies to the rotor, the rotor chamber, the centrifuge lid and the rotor cover. Therefore, it is advantageous if the connection between the centrifuge lid and the rotor cover can be released manually. The rotor cover is thus attached to the centrifuge lid in such a way that an operator can remove it. After that, the rotor cover can be cleaned as a separate part. The rotor cover can then be reattached to the centrifuge lid. Thereafter, the device according to the present invention is operational again, and the rotor cover can again be closed automatically with the centrifuge lid and can be placed on the rotor. In addition, manual placing of the rotor cover on the rotor is still possible.

The centrifuge lid is preferably a hinged lid and the holder is arranged on the centrifuge lid, the holder being essentially U-shaped and being open on its side facing the free end of the centrifuge lid in order to form a removal opening for the holding arm. The two arms of the U-shaped holder thus point with their free ends towards the free end of the centrifuge lid. On the side of the holder facing away from the centrifuge lid, the ends of the arms are bent perpendicularly towards each other and form a rail in this area which is arranged parallel to the surface of the centrifuge lid. The head of the holding arm engages behind this rail and is thereby fixed to the centrifuge lid. In other words, the rotor cover is suspended with the head of its holding arm in the U-shaped holder, behind the rail. On the open side of the U-shaped holder, a removal opening is thus formed through which the holding arm can be removed from the holder and thus the rotor cover can be removed from the centrifuge lid. Thus, when the centrifuge lid is open, the operator can detach the rotor cover from the centrifuge lid from which it is suspended simply by lifting it in the direction of the free side of the centrifuge lid. In order to reattach the rotor cover to the centrifuge lid, the head of the holding arm merely needs to be guided behind the rail of the holder, whereby the rotor cover is suspended at the centrifuge lid. The rotor cover can thus be easily separated from the centrifuge lid and cleaned. No disadvantages arise for the operator from the device according to the present invention, as he still has the option to manually separate the rotor cover from the centrifuge lid.

In order to further improve the reliability of the positioning of the rotor cover on the rotor, it is advantageous if a centering device is provided which centers the rotor cover on the rotor during the closing of the centrifuge lid. Basically, such centering can be achieved in different ways. It is, however, preferred to have a centering pin which is arranged either on the rotor or on the rotor-side end of the holding arm, and which engages a complementarily arranged channel when the centrifuge lid is closed, which channel is either arranged in the rotor-side end of the holding arm or in the rotor and is preferably widened towards its end facing the centering pin. The centering pin and the channel arranged in a complementary manner to the centering pin thus center the rotor cover by the engagement of the centering pin in the channel on the rotor. It is irrelevant whether the centering pin is arranged on the rotor cover and the channel on the rotor or the centering pin is arranged on the rotor and the channel on the rotor cover. The important aspect is that the centering pin and the channel are positioned relative to each other in such a way that the rotor cover comes to rest on the rotor exactly in the intended position when the centering pin is inserted in the channel. The preferred widening of the channel at its end facing the centering pin serves to compensate tolerances and to achieve exact positioning even if the centering pin is not moved towards the opening of the channel in a precisely fitting manner. The widened section has suitable funnel-shaped sloped surfaces, which guide the centering pin into the channel during the closing of the centrifuge lid. Inaccuracies caused by the swinging movement of the rotor cover relative to the centrifuge lid are also compensated in this manner.

In order to further support this effect, it is preferred that the centering pin has a tapering, particularly rounded, centering surface at its free end. Particularly, in combination with the widened section of the channel arranged as a funnel, along the sloped surfaces of which the centering surface of the centering pin can slide, a reliable engagement of the centering pin in the channel can be achieved. The rotor cover is positioned exactly on the rotor and tolerances caused by the swinging movement, for example, are compensated. As a result, wedging is prevented and error free opening and closing of the centrifuge according to the present invention is ensured.

BRIEF DESCRIPTION OF THE DRAWINGS

The present invention is explained below in greater detail with reference to some exemplary embodiments, which are shown in the figures without restricting the present invention to these exemplary embodiments. In the schematic figures.

Like reference numerals designate like elements. Repeatedly shown elements are not designated separately in each drawing.

DETAILED DESCRIPTION OF THE INVENTION

Figure 1:
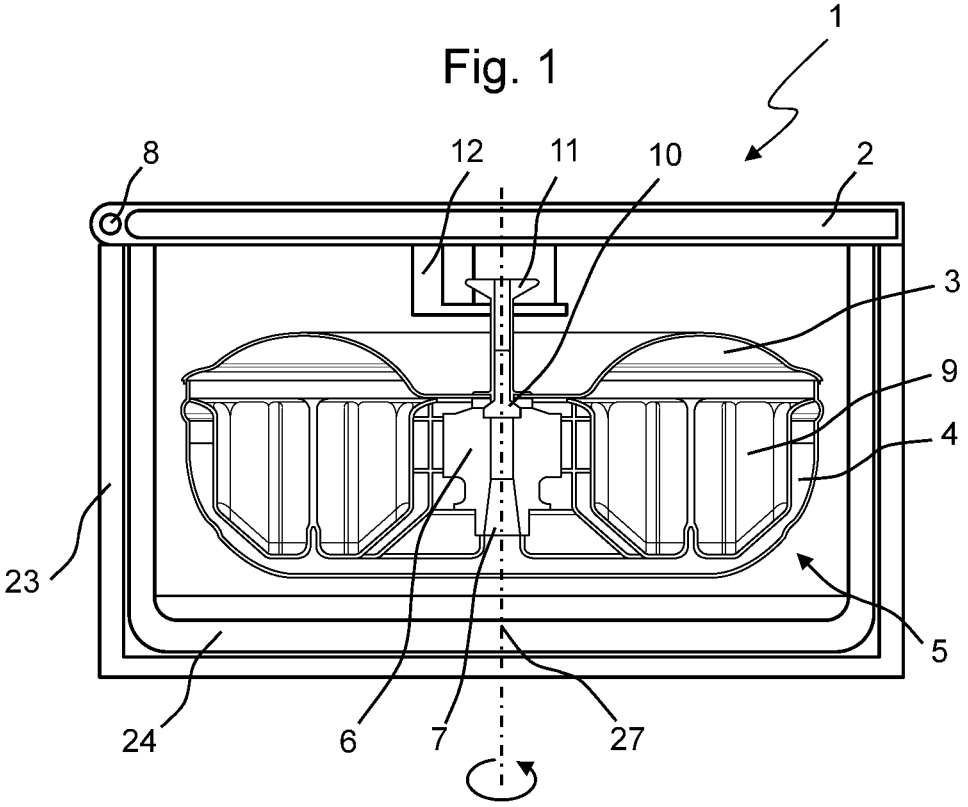
FIG. 1 is a sectional side view of a centrifuge in the closed state.

FIG. 1 shows a centrifuge 1 with a housing 23 comprising a centrifuge lid 2. The centrifuge lid 2 is a hinged lid and can be opened or folded open upwardly via the hinge 8. A guard ring 24, which is designed as a burst protection, and a rotor 5 are disposed within the housing 23. Further components that are not shown, such as a drive motor, a cooling compressor and a ventilation system, are also disposed within the housing 23, however these components are of minor importance for the present invention as they do not differ from corresponding prior art devices. The rotor 5 has a receptacle 7 for the drive shaft of the motor (both are not shown). The rotor 5 can be rotated about the axis of rotation 27 by the centrifuge motor. The rotor 5 has a rotor cross 6, a vessel 4 and centrifuge buckets 9 for accommodating sample vessels. Further, a centering pin 10, which will be described in more detail below, is arranged on the rotor 5.

The centrifuge 1 shown in FIG. 1 is in the closed state. That is, the rotor cover 3 rests centrally on the rotor 5. At the center of the rotor cover 3, an end of a holding arm 10 is attached, which protrudes upwardly from the rotor cover and is inserted with its other end in a holder 12 arranged at the center of the centrifuge lid 2. The holder 12 and the holding arm 11 engage each other, however, they are spaced from each other and thus decoupled. The centrifuge 1 is ready for operation, and the rotor 5 could thus be accelerated.

Figure 2:
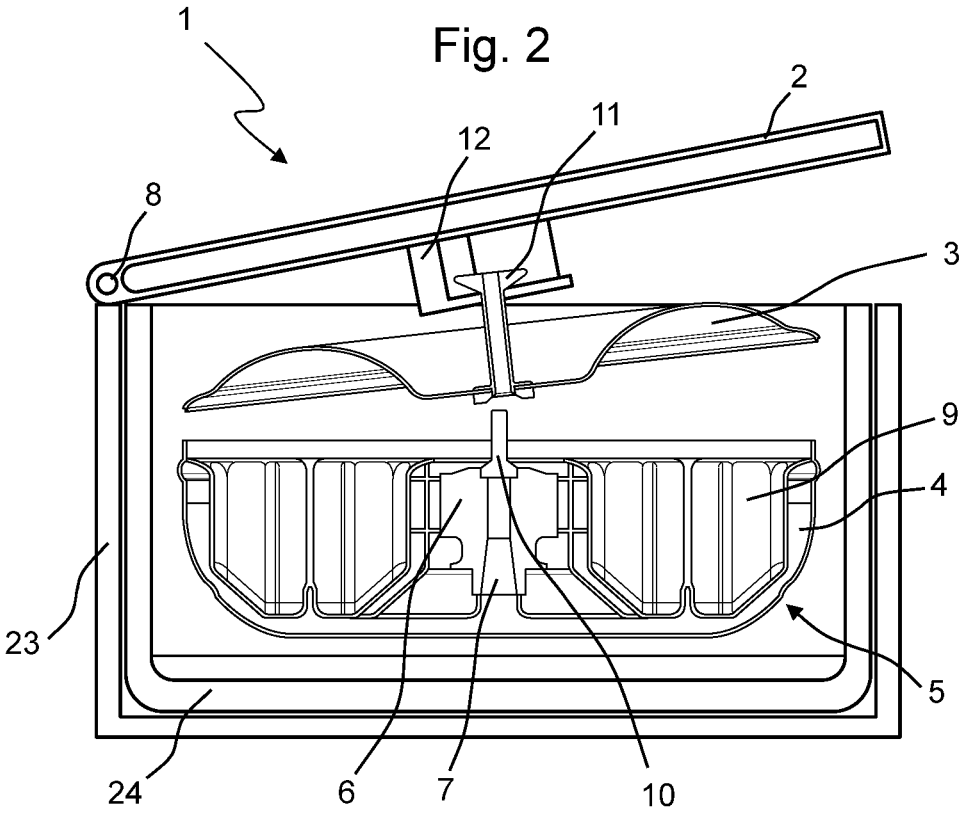
FIG. 2 shows the centrifuge of FIG. 1 in the half open/half closed state.
Figure 3:
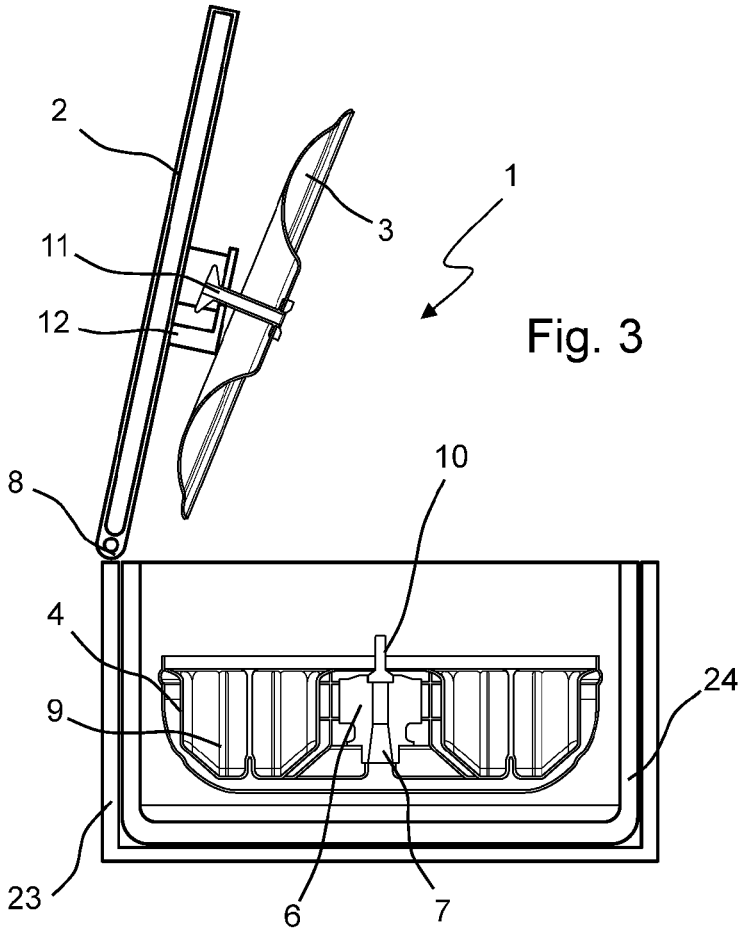
FIG. 3 shows the centrifuge of FIG. 1 in the open state.
Figure 4:
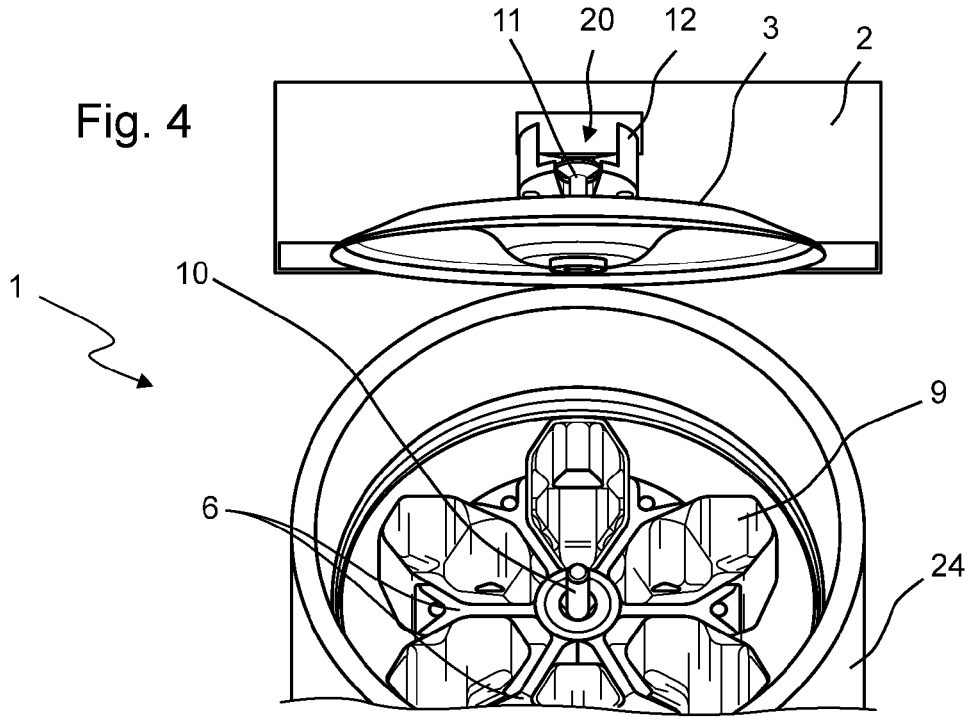
FIG. 4 shows the centrifuge of FIG. 3 from the perspective of an operator looking at the rotor.

FIGS. 1, 2 and 3 show an opening or closing process of the centrifuge 1. While the centrifuge 1 is closed in FIG. 1, the centrifuge lid 2 shown in FIG. 2 is in a slightly opened or almost completely closed state. The holding arm 11 and the holder 12 are in contact with each other, the rotor cover 3 is lifted off the rotor 5 due to the opening movement of the centrifuge lid 2 and is removed upwardly, or, respectively, is moved towards the rotor 5 due to the closing movement of the centrifuge lid 2 in order to place it in the position shown in FIG. 1. In FIG. 3 and FIG. 4, the centrifuge 1 is shown with completely opened centrifuge lid 2. In FIG. 4, the housing 23 is not shown for reasons of clarity of the illustration. The centrifuge 1 is shown from the perspective of an operator looking at the rotor 5 with its centrifuge buckets 9 for accommodating sample vessels. The rotor cover 3 is suspended via the holding arm 11 from the holder 12 of the centrifuge lid 2. If the centrifuge lid 2 is opened by an operator starting from the closed position shown in FIG. 1, this at first leads to the situation shown in FIG. 2 and then to the situation shown in FIG. 3. The rotor cover 3 follows the movement of the centrifuge lid 2 without any need for the operator to touch the rotor cover 3. If the centrifuge lid 2 is closed starting from the situation of FIG. 3, the stages shown in FIGS. 2 and 1 are passed in reversed order until the rotor cover 3 rests on the rotor 5 and the centrifuge lid 2 is closed. Again, it is not necessary for the operator to touch the rotor cover 3. Instead, the lifting off and placing on the rotor 5 takes place automatically due to the movement of the centrifuge lid 2 and the holder 12 arranged on the centrifuge lid 2 carrying along the holding arm 11 and the rotor cover 3, respectively.

Figure 5:
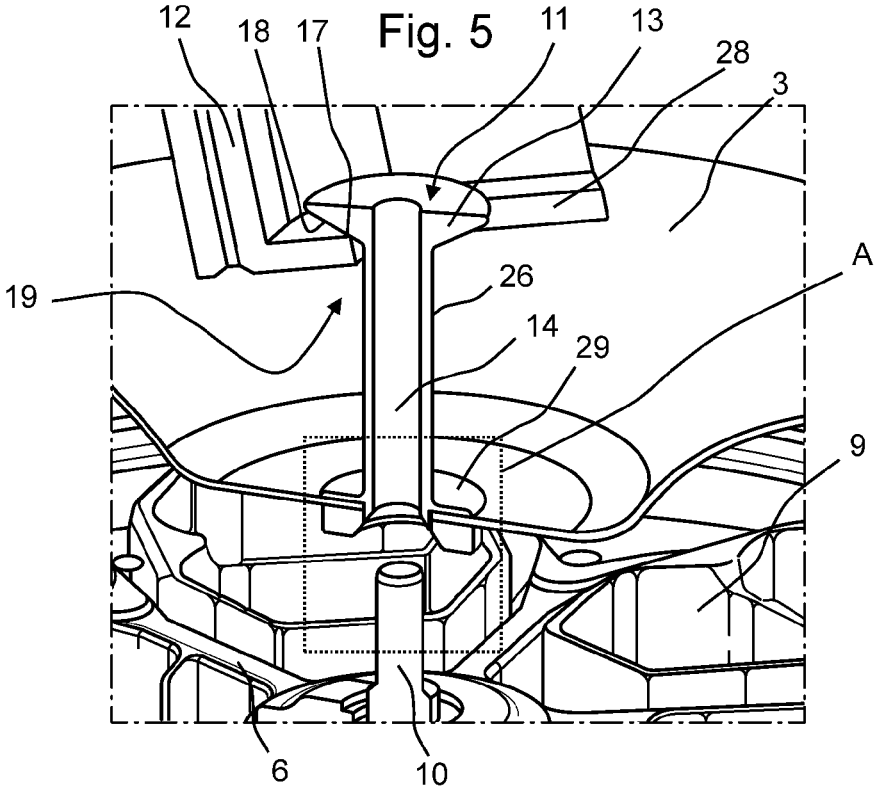
FIG. 5 is a perspective sectional view of an embodiment of a holding arm and a holder.
Figure 6:
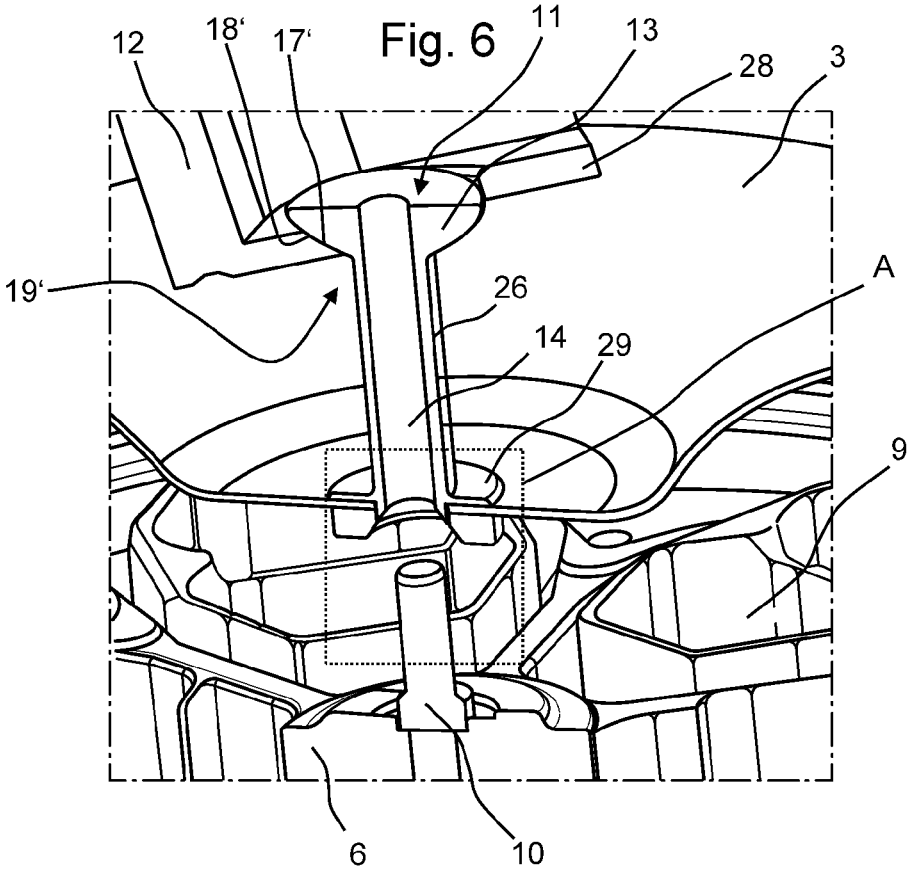
FIG. 6 is a perspective sectional view of another embodiment of a holding arm and a holder.

FIGS. 5 and 6 show a perspective sectional view cut through the holder 12 and the holding arm 11, as well as a part of the rotor 5 of the centrifuge 1. The holding arm 11 has a head 13, a body 26 and a base 29. With the base 29, the holding arm 11 is attached to the rotor cover 3. FIGS. 5 and 6 show a situation in which the holding arm 11 and the holder 12 rest against each other and the rotor cover 3 is suspended from the centrifuge lid 2 (which is not shown in FIGS. 5 and 6) via the holding arm 11 and the holder 12. The holding arm 11 engages the holder 12 and rests with its head 13 on the rail 28 of the holder 12. According to FIG. 5, the head 13 specifically has the shape of a truncated cone and rests with its lateral surface, the joint surface 17, on the joint surface 18 of the holder 12. Depending on the relative angle between the holding arm 11 and the holder 12, the support of the joint surface 17 on the joint surface 18 occurs as a two-point or as a three-point support. The joint surfaces 17, 18 together form the pendulum joint 19, via which the rotor cover 3 is connected with the centrifuge lid 2.

FIG. 6 shows an alternative embodiment, in which the head 13 is shaped as a spherical cap and rests with its rounded lateral surface, which represents the joint surface 17', on the joint surface 18' of the holder 12. The joint surface 18' is formed in a complementary fashion to the spherical joint surface 17' and forms a joint socket. The two joint surfaces 17', 18' form a pendulum joint 19', which according to FIG. 6 is arranged as a ball joint and thus allows for a particularly precise swinging movement of the rotor cover 3 relative to the centrifuge lid 2 and the rotor 5. The detachable connection between the centrifuge lid 2 and the rotor cover 3 is closed in FIGS. 5 and 6. The rotor cover 3 is suspended with its entire weight from the centrifuge lid 2 via the pendulum joint 19, 19'. If the centrifuge lid 2 is further closed or opened, the rotor cover 3 follows the movement of the centrifuge lid 2.

Figure 7:
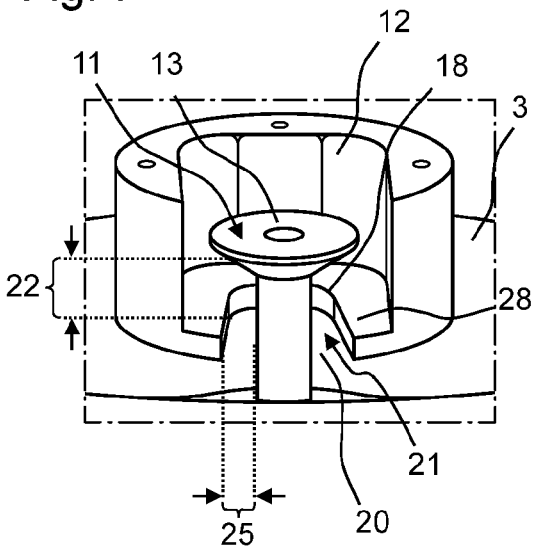
FIG. 7 is a detail view of an embodiment of a holding arm and a holder.
Figure 8:
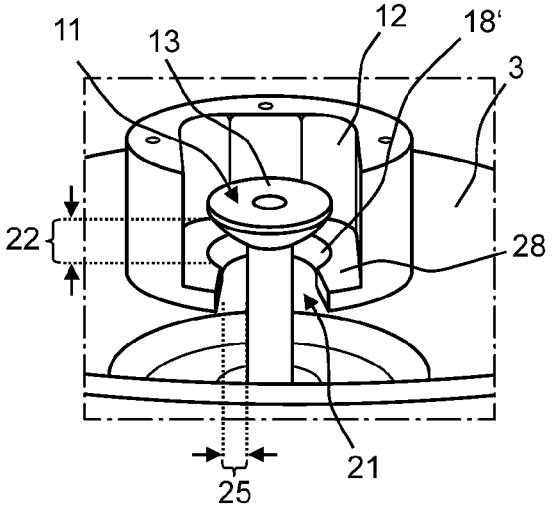
FIG. 8 is a detail view of another embodiment of a holding arm and a holder.

FIGS. 7 and 8 show the position of the holding arm 11 relative to the holder 12 when the centrifuge lid 2 is completely closed. The detachable connection between the centrifuge lid 2 and the rotor cover 3 is detached. In the situation shown, the rotor cover 3 rests on the rotor 5. For reasons of visibility, the centrifuge lid 2 is not shown. The holding arm 11 is spaced from the holder 12 via a gap space 21. The gap space 21 is composed of a vertical projection 22 and a horizontal spacing 25. The vertical projection 22 is achieved by an excess length of the holding arm 11, in particular, of the body 26 of the holding arm 11. The horizontal spacing 25 is created by the holding arm 11, in particular, the body 26 of the holding arm 11, being thinner than the central recess of the U-shaped holder 12. The holding arm 11 is thus spaced from the holder 12 both horizontally as well as vertically via the gap space 21. This allows for the holding arm 11 to rotate together with the rotor 5 and the rotor cover 3 resting thereon during the operation of the centrifuge 1, without the holding arm 11 colliding, or making otherwise contact, with the holder 12.

FIGS. 7 and 8 further show the rail 28 of the holder 12, which narrows the area between the two U-arms of the holder 12 in such a way that the widened head 13 of the holding arm 11 engages behind the rail 28, and an opening of the centrifuge lid 2 and an essentially vertical lifting of the holder 12 will result in the joint surfaces 17, 17' of the head 13 and the joint surfaces 18, 18' of the holder 12 abutting each other. Due to the folding movement of the centrifuge lid 2 and the weight of the rotor cover 3, the latter is pulled towards the closed side of the U-shaped holder when the centrifuge lid 2 is opened. The head 13 of the holding arm 11 is larger than the opening of the U-shaped holder 12, which is delimited by the rail 28 and faces away from the centrifuge lid 2. The holding arm 11 is thus suspended in the holder 12 and cannot by itself slip out of the holder 12 during opening or closing of the centrifuge 1.

Figure 9:
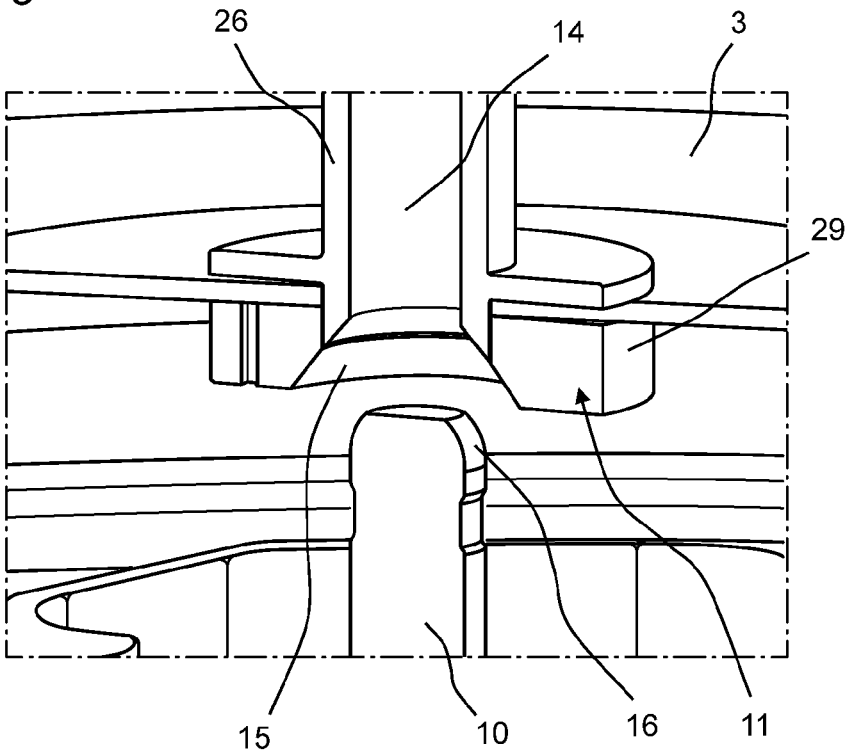
FIG. 9 is a detail view of sector A of FIGS. 5 and 6.

FIG. 9 is a detail view of sector A of FIGS. 5 and 6 and shows an enlarged sectional view of the rotor-side end of the holding arm 11 with a centering device according to the present invention. A channel 14 is provided inside the body 26 of the holding arm 11, in which channel a centering pin 10 can be inserted which is arranged on the rotor 5. The channel 14 completely extends through the holding arm 11 from one end to the other. However, it is also possible for the channel 14 to only extend through a part of the holding arm 11, so that the channel 14 has a blind end in the holding arm 11. In the shown exemplary embodiments, the holding arm 11 penetrates the rotor cover 3 with its base 29. However, it is also possible to arrange the holding arm 11 only on one side of the rotor cover 3. In this case, the channel 14 likewise extends through the rotor cover 3 or is arranged on the rotor 5, while the centering pin 10 is arranged on the rotor cover 3.

FIG. 1 shows the centering pin 10 when inserted in the channel 14. By inserting the centering pin 10 in the channel 14, the rotor cover 3 is aligned centrally above the rotor 5 and placed on the rotor 5 in the correct, i.e., intended position. FIGS. 5, 6 and 9 show the situation shortly before insertion of the centering pin 10 in the channel 14. At its end facing the centering pin 10, the channel 14 has a widened section 15. This widened section 15 has the shape and the function of a funnel, which is to guide the centering pin 10 into the channel 14 even if the rotor cover 3, or the holding arm 11, respectively, is not positioned exactly above the centering pin 10. The exact positioning of the rotor cover 3 relative to the rotor 5 is achieved by arranging the channel 14 as complementary to the centering pin 10 and having a diameter that corresponds to the diameter of the centering pin 10 in such a way that the centering pin 10 closely slides along the inner surface of the channel 14 during the placing of the rotor cover 3 on the rotor 5. In this manner, the rotor cover 3 is positioned, or centered, on the rotor 5.

In order to further simplify the insertion of the centering pin 10 in the channel 14 and, in particular, to prevent wedging and jamming, the centering pin 10 has a centering surface 16 at its free end, with which it enters the channel 14. The centering surface 16 constitutes a rounded section of the centering pin 10 and slides along the funnel-shaped surfaces of the widened section 15 of the channel 14. In this manner, a precise centering and a safe closing of the rotor 5 is achieved even if the rotor cover 3 is not positioned exactly above the rotor.

Figure 10:
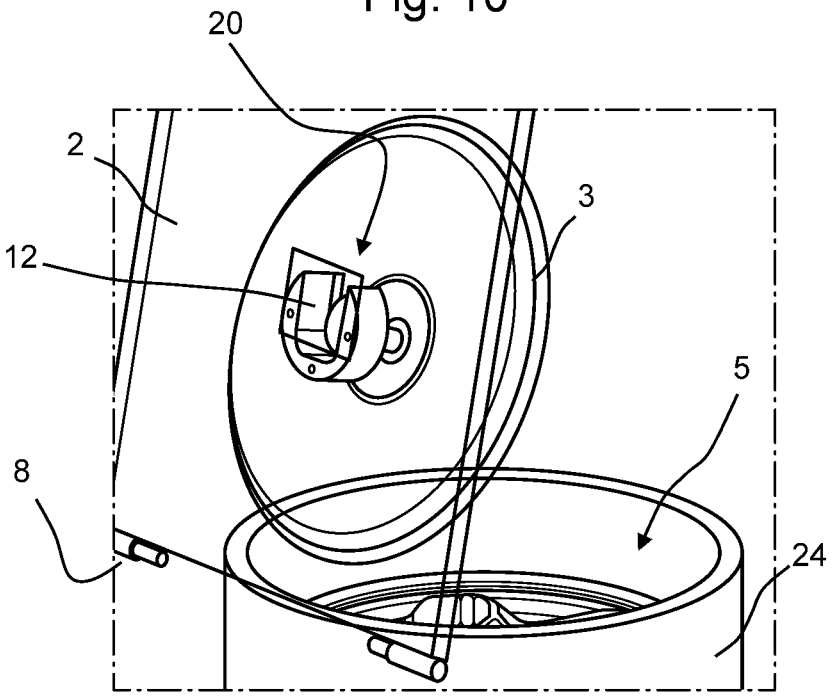
FIG. 10 is a perspective lateral rear view of a holder.
Figure 11:
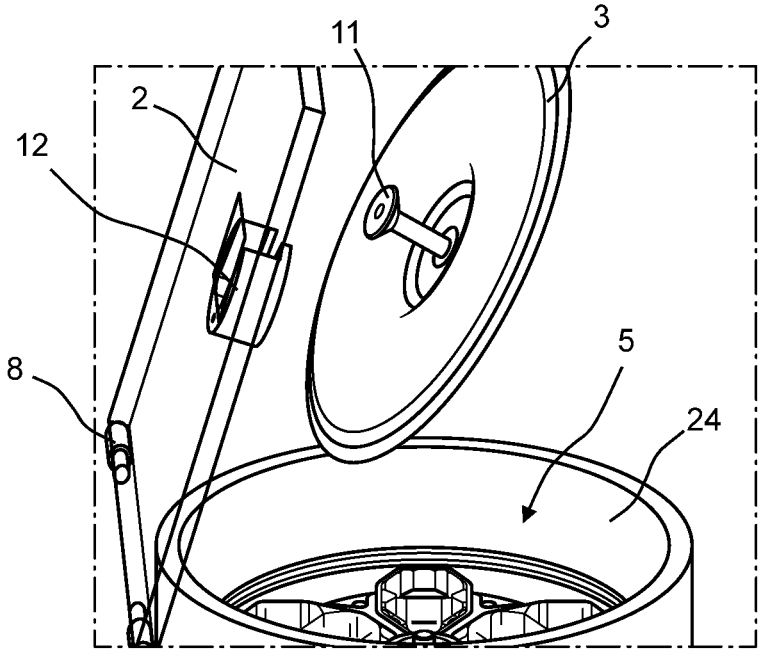
FIG. 11 is a perspective side view of the holder of FIG. 10 with released rotor cover.

FIGS. 10 and 11 show the option of removing the rotor cover 3 from the centrifuge lid 2, which is shown as transparent in FIGS. 10 and 11 for reasons of illustration, by an operator via the removal opening 20 on the open side of the U-shaped holder 12. For this purpose, an operator merely needs to lift the rotor cover 3 in the direction of the free end of the centrifuge lid 2. The widened head 13 of the holding arm 11 is guided along, or past, the rail 28 of the holder 12 until the holding arm 11 is disengaged from the holder 12 and can be removed therefrom. The rotor cover 3 and the surface of the centrifuge lid 2 with the holder 12 can then be cleaned. To reattach the rotor cover 3 on the centrifuge lid 2, the holding arm 11 is merely suspended in the holder 12 by proceeding in reversed order.

While the present invention has been illustrated by description of various embodiments and while those embodiments have been described in considerable detail, it is not the intention of Applicant to restrict or in any way limit the scope of the appended claims to such details. Additional advantages and modifications will readily appear to those skilled in the art. The present invention in its broader aspects is therefore not limited to the specific details and illustrative examples shown and described. Accordingly, departures may be made from such details without departing from the spirit or scope of Applicants invention.

What is claimed is:

1. A centrifuge, comprising:

a housing comprising a centrifuge lid which is a hinged lid and delimits the centrifuge to the outside;

a rotor;

a rotor cover for closing the rotor; and a connecting device comprising a holding arm and a holder, via which the rotor cover and the centrifuge lid are detachably connected with each other in such a way that the rotor cover is lifted off the rotor upon opening of the centrifuge lid and is placed on the rotor upon closing of the centrifuge lid, wherein one of the holding arm or the holder is arranged on the rotor cover and the other is arranged on the centrifuge lid, wherein the holding arm is detachably and movably mounted in the holder during opening and closing of the centrifuge lid and the holding arm and the holder are spaced from each other by a gap space when the centrifuge lid is closed, wherein the holding arm has a widened head having a joint surface which is designed as form-locking with a joint surface of the holder in such a manner that the holding arm and the holder form a pendulum joint, and further wherein the holder is U-shaped and is open at a side of the holder facing a free end of the centrifuge lid in order to form a removal opening for the holding arm.

2. The centrifuge according to claim 1, wherein one end of the holding arm is arranged on the rotor cover and the other end of the holding arm is arranged in the holder on the centrifuge lid.

3. The centrifuge according to claim 1, wherein the connecting device is arranged at the center of the centrifuge lid and the rotor cover.

4. The centrifuge according to claim 1, wherein the joint surface of the holder is a joint socket and the joint surface of the holding arm is a joint head of a ball joint.

5. The centrifuge according to claim 1, wherein a centering pin is provided which is arranged either on the rotor or at the rotor-side end of the holding arm and which, when the centrifuge lid is closed, engages a complementarily formed channel which is arranged either in the rotor-side end of the holding arm or in the rotor.

6. The centrifuge according to claim 5, wherein the centering pin has a tapering centering surface (16) at a free end of said centering pin.

7. The centrifuge according to claim 6, wherein the centering pin has a rounded centering surface.

8. The centrifuge according to claim 5, wherein said channel is widened towards an end of said channel facing the centering pin.

* * * * *